United States Patent [19]

Murphy

[11] 4,207,697

[45] Jun. 17, 1980

[54] MAGNETIC STRIP ATTACHMENT FOR SIGNS

[76] Inventor: Ralph W. Murphy, 832 Second St., Marietta, Ohio 45750

[21] Appl. No.: 935,516

[22] Filed: Aug. 21, 1978

[51] Int. Cl.[2] ..... G09F 7/04

[52] U.S. Cl. ..... 40/600; 40/611; 40/621; 156/308.6

[58] Field of Search ..... 40/600, 611, 621; 428/900; 35/7 A; 156/308; 248/206 A

[56] References Cited

U.S. PATENT DOCUMENTS

| | | | |
|---|---|---|---|
| 1,624,741 | 4/1927 | Leppke et al. | 40/621 |
| 1,924,429 | 8/1933 | Winzeler | 156/308 |
| 3,122,684 | 2/1964 | Genin | 40/621 |
| 3,797,151 | 3/1974 | Dexter | 40/600 X |
| 3,987,567 | 10/1976 | Fritts | 40/600 |

FOREIGN PATENT DOCUMENTS

| | | | |
|---|---|---|---|
| 657562 | 9/1951 | United Kingdom | 40/621 |

*Primary Examiner*—John F. Pitrelli
*Assistant Examiner*—G. Lee Skillington
*Attorney, Agent, or Firm*—Robert E. Stebens

[57] ABSTRACT

A magnetic strip assembly for signs is provided for use in attaching a sign to the surface of a structure formed from a ferromagnetic metal. This device, which utilizes solvent welding or instead of pressure sensitive adhesives, allows for a more effective attachment of signs to metal surfaces. Other devices for the attachment of signs to metal surfaces utilizes pressure sensitive adhesives which are prone to adhesive failure, which is not a problem with this device. This magnetic strip assembly includes a flexible magnetic strip preferably with two flanges thereby creating a slot, a flexible mounting strip which is inserted into the slot of the magnetic strip thereby providing for mechanical interconnection, and a plastic sign which is fastened to the mounting strip by means of solvent welding. The solvent weld provides an extremely effective means of adhesion.

6 Claims, 5 Drawing Figures

MAGNETIC STRIP ATTACHMENT FOR SIGNS

BACKGROUND OF THE INVENTION

This invention is directed to the providing of an effective method of attaching the flexible magnetic strip to a plastic sign in the making of one type of magnetic signs. One major instance of commercial utilization is in advertising where a sign is often placed on an automative vehicle to promote a company or an individual. This new method offers substantial improvement over existing methods of sign attachment the most common of which utilize pressure sensitive adhesives to effect the desired result.

Several devices for attaching a sign to the magnet exist for use and in the making of the magnetic sign and, as previously mentioned, one important type of these devices utilizes pressure sensitive adhesives to secure strips of magnetic material to a sheet plastic display structure. One of the main problems common to such signs utilizing known sensitive adhesives is adhesive failure which frequently occurs and results in the loss of the means of holding the plastic to the side of the automobile. The bonding agent that holds the magnetic strip to the plastic display structure must perform satisfactory in a range of temperatures from hot to cold, dry to wet, and clear to dusty conditions for a satisfactory magnetic sign product. The need for a new process exists since adhesives often fail under some of the above conditions.

SUMMARY OF THE INVENTION

In accordance with this invention, a device is provided for effective attachment of a magnetic strip assembly to the plastic sheet display strucuture in as much that the new process provides a permanent bond between the magnetic strip assembly and the above mentioned plastic sheet display structure. The magnetic strip assembly includes two parts:

1. A magnetic strip, made in the shape of a C channel, is made by embedding a magnetic ferite powder in a plastic binder, forming it into desired shape and magnetizing it. 2. A mounting strip or insert strip is made from a suitable plastic and to a shape to fit in the channel in the magnet for a mechanical holding effect.

The sign is also formed from a suitable plastic with the insert strip secured to the sign by the use of an appropriate solvent in a solvent welding technique. The bonding agent is a mixture of various solvents and dissolved plastic. The plastic may or may not be of the same composition as that of the insert strip.

This method of attaching the magnetic strip assembly to a plastic sign or materials can be utilized in the making of magnetic signs where the surface can be either flat or with raised letters. The commonly used raised letters signs, made by the vacuum forming process, are produced with the magnet attached to the flat surface and also with the magnet assembly vacuum formed around the sign and used as a border. This new concept will perform for both methods.

When the magnetic strip assembly is solvent welded to any flat plastic surface, the bonding agent is placed on either or both of the two plastic surfaces and both are brought into contact with each other. When the plastic sheet is vacuum formed around the magnetic strip, the strip is placed in position the same as the letters and markings on the sign with the sheet vacuum formed around it. For aesthetics, the magnetic strip assembly is placed on the forming plate with the magnet turned up to prevent the forming of two unwanted lines that separate the strip form the insert.

When the sign cools, the magnetic strip assembly is removed from the plastic track and the bonding agent is applied either in the track of the plastic or preferably on the plastic insert of the strip and the strip is placed back into the track.

By employing a solvent welding technique, the need for pressure sensitive adhesives is eliminated. Through the elimination of the need for those adhesives, the problem of adhesive failure is also eliminated. The elimination of adhesive failure by utilizing solvent welding allows for longer use of the sign due to the increased attachment period.

The primary object of the invention is to provide an effective method for the attachment of a sign to a ferromagnetic metal surface, with the removable feature as provided in a magnetic sign.

Another object of this invention is to provide an effective method to keep a sign attached to the mounting strip.

Still another object of this invention is to provide a relatively simple and inexpensive process to attach signs to metal surfaces.

Another object of this invention is to provide for the solvent welding of a sign base to an elongated magnetic attachment strip.

These and other objects and advantages of this invention will be readily apparent from the following detailed description of an illustrative embodiment thereof. Reference will be had to the accompanying drawings.

DESCRIPTION OF THE DRAWING FIGURES

DESCRIPTION OF THE ILLUSTRATIVE DRAWING FIGURES

Figure 1:
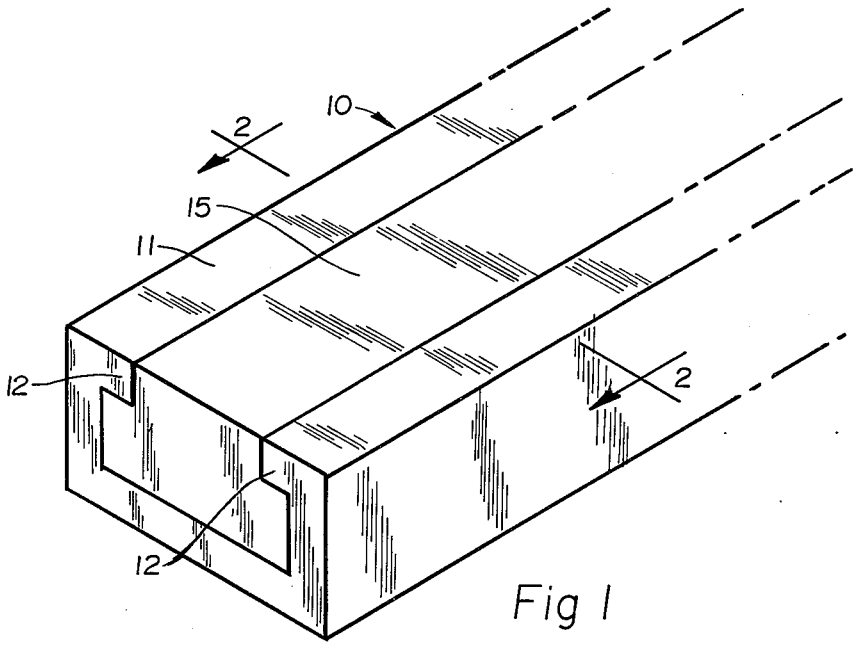
FIG. 1 is a perspective view of a fragmentary section of an elongated magnetic attachment strip embodying this invention.

Having reference to the drawings, attention is directed first to FIG. 1 which illustrates a structure combining two strips designated generally by the numeral 10. This structure is comprised of a magnetic strip 11 and a plastic insert 15 which functions as a mounting for the magnetic strip. The magnetic strip is of a C-shaped cross sectional configuration having two flanges 12 creating a slot in which the plastic insert 15 is mounted. The flanges 12 allow for the plastic insert 15 to be mechanically interconnected to the magnetic strip 11 in frictional engagement.

Figure 2:
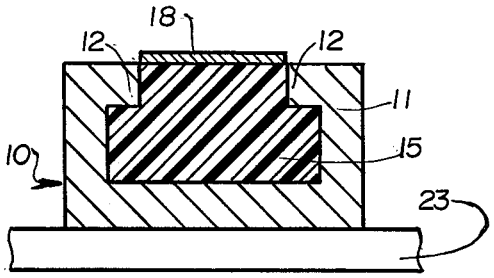
FIG. 2 is a vertical sectional view taken along line 2—2 of FIG. 1.
Figure 3:
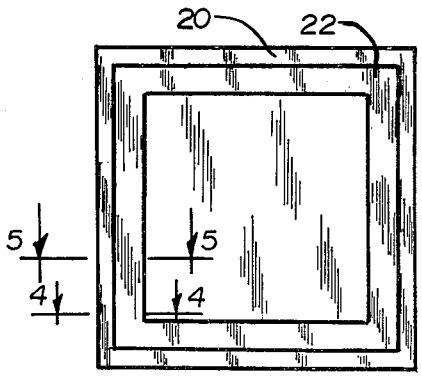
FIG. 3 is a rear view of the sign following the vacuum forming process.
Figure 4:
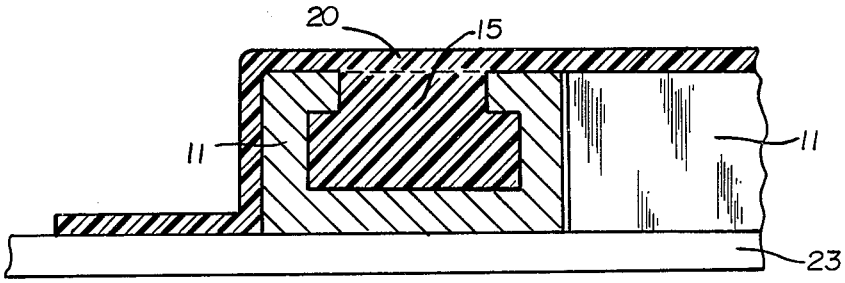
FIG. 4 is a vertical sectional view taken along line 4—4 of FIG. 3.

The magnetic strip is also capable of attachment by magnetic forces to the surface 23 of an object which is formed from an appropriate metallic material as shown in FIG. 2. This metal surface would be the one on which the sing is desired to be attached. The magnetic strip 11 would preferably be comprised of synthetic rubber and barium ferrite, but could be comprised of other materials such as flexible plastics with appropriate ferromagnetic oxides suspended therein. Flexibility is needed for attachment to other than flat planar surfaces.

the plastic insert 15 is mechanically attached to the magnetic strip 11 and when secured to a sign structure, forms a mounting strip for the magnetic strip. The plastic insert could be composed of a variety of materials including polyvinylchloride (PVC), or an acrylate resin such as acrylonitritestyrene acrylic teripolymer resin (ASA) or an acrylonitrilebutadiene-styrene resin (ABS). The flexibility of the plastic insert can be varied as it is necessary in many cases to allow the sign to be affixed to curved surfaces of metal such as automobile doors, but a certain degree of rigidity is needed to hold it in the pocket of the C-shaped magnetic strip.

The sign base or structural body 20 could be composed of a vinyl plastic or thermoplastic resin such as ASA or ABS. Many commercial signs presently use these substances in their composition. Whereas the plastic insert and magnetic strip 11 are mechanically interconnected, the sign base 20 and plastic insert 15 employ solvent welding as a means of attachment as shown in FIG. 2. Solvent welding utilizes the principle of dissolving and or softening two plastic materials in a common solvent base, joining the two materials together and allowing the solvents to evaporate in the atmosphere. This forms a mechanical bond. Solvent welding overcomes the problem of adhesive failure encountered by similar signs now in existence. Although sign makers have tried to find a strong pressure sensitive adhesive, for all weather conditions, their efforts have not been totally successful. This invention does not rely on any pressure sensitive adhesive or clamps to secure the sign base to the mounting strip. It is in this aspect that this device is substantially different than other magnetic fastening devices such as Baermann's U.S. Pat. No. 3,241,198 and 2,959,832. Previous magnetic fastening devices for use with plastic signs have been susceptible to failure because of adhesive failure, but in this device, since there is no pressure sensitive adhesive, that problem is eliminated. This principle can be employed when using rigid plastics, as long as the plastic insert in the magnet and the rigid plastic of the sign or other object are dissolvable in a common solvent and that solvent is used.

Figure 5:
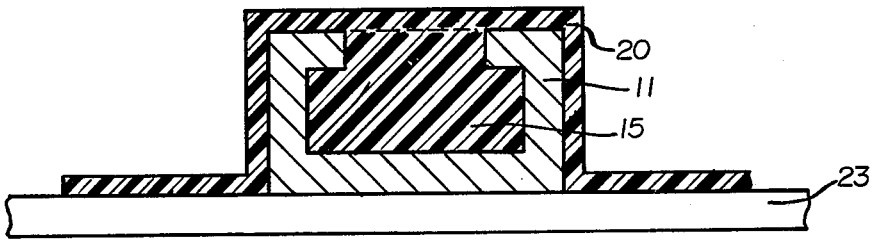
FIG. 5 is a vertical sectional view taken along line 5—5 of FIG. 3.

In the magnetic sign industry where the vacuum formed process is used and for which application this principle was chiefly designed, there are two methods for mounting the magnetic strip when pressure sensitive adhesive is used. One is the application of the magnetic strip on a flat surface after the plastic has been vacuum formed. The other is forming the plastic sheet of the sign material 20 around the magnet assembly as shown in FIG. 5. This principle can be utilized in both methods simply by applying the bonding agent, which consists of the solvent and dissolved plastic, to either or both of the surfaces on the sign or the insert but most preferably on the insert and joining the two together and left without disturbing until a bond is formed when the solvent has left.

The solvent 18 is a mixture of tetrahydrofuran (THF), methyl ethyl ketone (MEK), and polyvinylchoride (PVC) in solution. The solvent is applied to the plastic insert strip which is then pressed against the sign base to effect the solvent welding. THF is a good solvent for plastics, particularly vinyls. In addition, it evaporates faster than many other solvents. This is extremely important because in solvent welding the solvent 18 acts to put the outer layers of both the base 20 and the strip 15 into solution. When the solvent 18 evaporates, the residue mechanically fuses together creating a weld. The use of a fast evaporating solvent and proper quantity is important because if the solvent is allowed to act on the surfaces for too long a time, it eventually will cause the front of the sign face to pucker. Therefore, THF allows the outer rear surface of the sign base to go into solution and evaporates before the solvent can act on the front surface of the sign thereby preserving its aesthetic appeal. Similarly, MEK is a solvent which dissolves PVC, ASA, and ABS. PVC is in solution to fill any holes or spaces between the two plastic materials that may result when they are being solvent welded. When the solvent evaporates, the PVC solidifies and mechanically bonds to the two plastics being solvent welded together to form the securely welded juncture.

It will be readily apparent from the foregoing detailed description of illustrative embodiments of this invention that a particularly novel and extremely effective device for attaching signs to metal surfaces is provided. This structure is relatively simple to fabricate, inexpensive, and requires a minimal amount of time for installation on an appropriate metal surface. Other areas of utilization of this magnetic attachment technique will be readily apparent to those knowledgeable in this field.

Having thus described this invention, what is claimed is:

1. A sign structure comprising a structural body adapted to be mounted on a metallic supporting surface and having a surface portion which is positionable in juxtapposed relationship to the supporting surface, an elongated magnetic strip formed from a flexible material and having a contacting surface which is adapted to be disposed in contacting engagement with a metallic surface in magnetically coupled engagement, and an elongated mounting strip for securing of said magnetic strip to said structural body with the contacting surface of said magnetic strip exposed throughout its length to engage the supporting surface, said mounting strip and magnetic strip formed to mechanically interfit in cooperative interlocking engagement with said mounting strip having a mounting surface disposed adjacent the structural body surface portion in contacting engagement therewith, said structural body and said mounting strip being formed from materials which can be solvent welded and they are secured together by solvent welding.

2. A structure according to claim 1 wherein said magnetic strip is comprised of magnetized particles suspended in a synthetic material.

3. A structure according to claim 1 wherein said magnetic strip and mounting strip are of a flexible composition, said composition such that it allows for effective attachment between the magnetic attachment strip and the metal surface on which the object composed of the base material is desired to be affixed.

4. A sign structure according to claim 1 wherein said magnetic strip and said mounting strip are formed with respective, longitudinally extending T-shaped slot and tongue conformations that are mechanically interfitting.

5. A sign structure according to claim 4 wherein said mounting strip is formed with the T-shaped tongue conformation which projects in outwardly extending relationship to the structural body.

6. A sign structure according to claim 5 wherein said magnetic strip has flanges defining the T-shaped slot and which project between the T-shaped tongue and the structural body surface portion in clamped relationship.

* * * * *